United States Patent [19]

Hull

[11] Patent Number: 4,846,255

[45] Date of Patent: Jul. 11, 1989

[54] ELECTROMAGNETIC AUGMENTATION FOR CASTING OF THIN METAL SHEETS

[75] Inventor: John R. Hull, Hinsdale, Ill.

[73] Assignee: The United States of America as represented by The United States Department of Energy, Washington, D.C.

[21] Appl. No.: 113,707

[22] Filed: Oct. 28, 1987

[51] Int. Cl.[4] ..... B22D 27/02; B22D 11/00

[52] U.S. Cl. ..... 164/502; 164/440; 164/503

[58] Field of Search ..... 164/467, 503, 502, 440, 164/490

[56] References Cited

U.S. PATENT DOCUMENTS

| | | | |
|---|---|---|---|
| 3,467,166 | 9/1969 | Getselev et al. . | |
| 3,985,179 | 10/1976 | Goodrich et al. . | |
| 4,126,175 | 11/1978 | Getselev . | |
| 4,161,206 | 7/1979 | Yarwood et al. . | |
| 4,375,234 | 3/1983 | Pryor . | |
| 4,414,285 | 11/1983 | Lowry et al. . | |
| 4,570,696 | 2/1986 | Yarwood et al. | 164/467 |
| 4,678,024 | 7/1987 | Hull et al. . | |

FOREIGN PATENT DOCUMENTS

| | | | |
|---|---|---|---|
| 43987 | 1/1982 | European Pat. Off. | 164/502 |
| 58-29550 | 2/1983 | Japan | 164/467 |

*Primary Examiner*—Kuang Y. Lin

*Attorney, Agent, or Firm*—Hugh W. Glenn; Robert J. Fisher; Judson Hightower

[57] ABSTRACT

Thin metal sheets are cast by magnetically levitating molten metal deposited in a mold within a ferromagnetic yoke and between AC conducting coils and linearly displacing the magnetically levitated liquid metal while it is being cooled by the water-cooled walls of the mold to form a solid metal sheet. A conducting shield is electrically coupled to the molten metal sheet to provide a return path for eddy currents induced in the metal sheet by the current in the AC conducting coils. In another embodiment, a DC conducting coil is coupled to the metal sheet for providing a direct current therein which interacts with the magnetic field to levitate the moving metal sheet. Levitation of the metal sheet in both molten and solid forms reduces its contact pressure with the mold walls while maintaining sufficient engagement therebetween to permit efficient conductive cooling by the mold through which a coolant fluid may be circulated. The magnetic fields associated with the currents in the aforementioned coils levitate the molten metal sheet while the mold provides for its lateral and vertical confinement. A leader sheet having electromagnetic characteristics similar to those of the molten metal sheet is used to start the casing process and precedes the molten metal sheet through the yoke/-coil arrangement and mold and forms a continuous sheet therewith. The yoke/coil arrangement may be either U-shaped with a single racetrack coil or may be rectangular with a pair of spaced, facing bedstead coils.

8 Claims, 7 Drawing Sheets

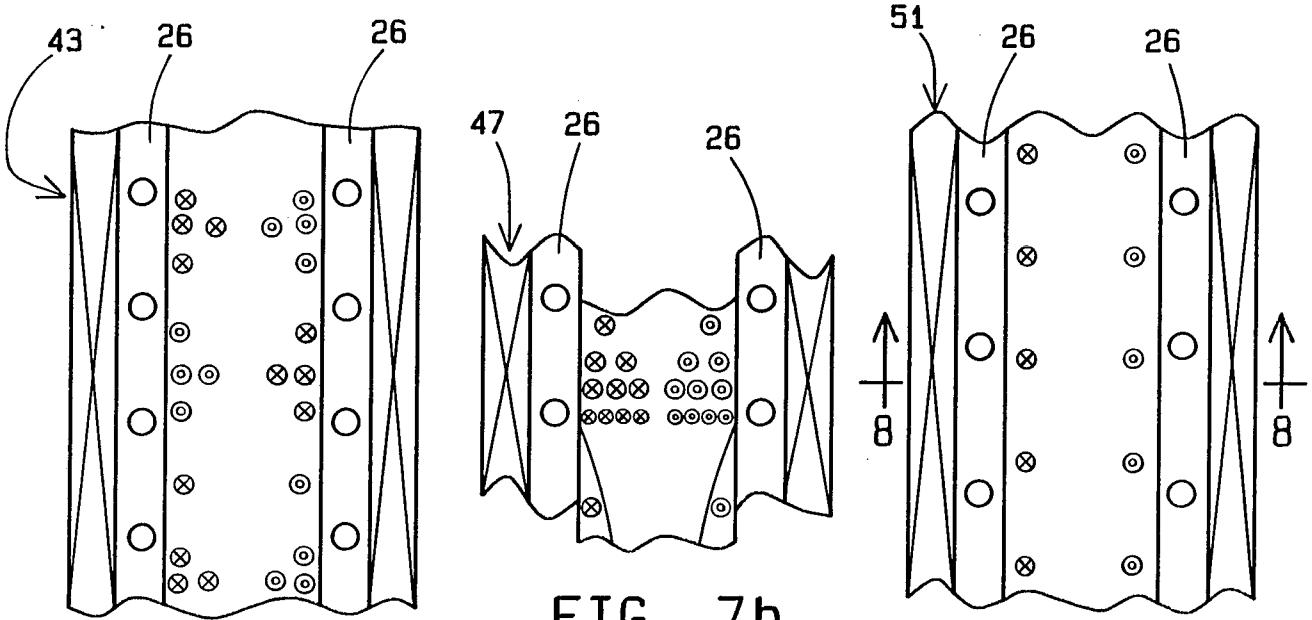
FIG. 7c
FIG. 7b
FIG. 7a
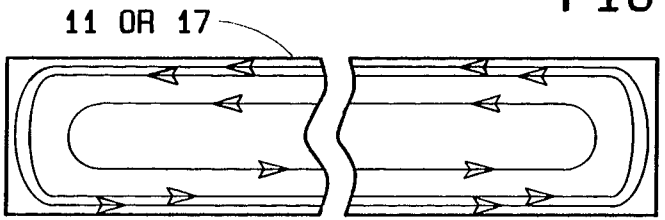
FIG. 8

ELECTROMAGNETIC AUGMENTATION FOR CASTING OF THIN METAL SHEETS

CONTRACTUAL ORIGIN OF THE INVENTION

The United States Government has rights in this invention under Contract No. W-31-109-ENG-38 between the U.S. Department of Energy and the University of Chicago, representing Argonne National Laboratory.

BACKGROUND OF THE INVENTION

This invention relates generally to the casting of metal sheets and is particularly directed to the use of electromagnetic methods in the casting of thin metal sheets.

The use of electromagnetic methods in the casting of steel is receiving increasing attention. Electromagnetic stirring has been used for many years to improve the grain structure of cast ingots. Electromagnetic confinement methods have been commercially used for several years in the vertical casting of large ingots of aluminum and copper, and perhaps other metals. Examples of this approach can be found in U.S. Pat. Nos. 3,467,166 to Getselev et al, 3,985,179 to Goodrich et al, 4,126,175 to Getselev, 4,161,206 to Yarwood et al, 4,414,285 to Lowry et al, and 4,375,234 to Pryor. More recently, attention has been focused on near net shape casting, and in particular to the casting of thin sheets of steel. Such products are used to make auto bodies, housing siding products, appliance housings, etc.

It is advantageous to cast metal as relatively thin sheets of about ¼ inch thickness rather than large ingots with thickness of 6 inches or more, primarily because energy and capital expense associated with hot rolling can be eliminated. The ¼ inch thick sheets can be cold rolled after minimal or no hot rolling into the final thickness and metallurgical structure. If a thin sheet caster could be developed, it would significantly reduce the cost of sheet steel. In a conventional installation, a 10 inch thick steel slab must be manipulated by at least ten rolling machines to reduce its thickness. The rolling mill may extend as much as one-half mile and cost as much as $500 million.

Molten metal cannot be cast directly as thin sheets in a conventional casting situation where the metal is poured or forced under pressure to pass through a thin rectangular slot in a mold with walls that are water cooled. The reason is that as the metal solidifies, it sticks to the mold walls. In a conventional caster, the mold is often mechanically vibrated to loosen the sticking metal, essentially applying a tangential force to rip the frozen metal away from the mold wall. This results in a very poor quality and uneven surface when the slab leaves the caster. For thick slabs, the surface quality is not of major concern because the entire slab is mechanically worked in rolling mills. For thin sheets, the casting process just described is unusable because it would tear the sheet apart. Mainly because of this sticking problem, the use of moldless electromagnetic casting has been suggested for the production of thin metal sheets in the casting process.

Representative of such technology is U.S. Pat. No. 4,678,024 to Hull et al, the disclosure of which is hereby incorporated by reference in the present application. In this approach, electromagnetic levitation is used in the casting of thin metal sheets having a thickness on the order of ¼ inch as the sheet leaves the caster . The electromagnetic field levitates and confines the molten sheet and prevents the metal sheet from touching a mold wall. The molten metal is cooled and solidified by radiant cooling and by directing a gas or mist stream over the relatively slow moving metal sheet.

However, moldless electromagnetic casting has a number of disadvantages. First, it is difficult to cool the molten metal sheet quickly. Both radiant cooling and convective cooling by a gas are much less efficient than conductive cooling by contact of the molten metal with a cold mold wall that is water cooled. The use of gas cooling requires the use of an inert gas, such as argon, helium, or possibly nitrogen, that does not chemically interact with the molten metal. Although analysis and experiments are not yet conclusive, it appears that inexpensive coolants such as steam or gas containing water mist may not be used in the cooling process. The amount of inert gas needed in the cooling process may render moldless casting too expensive to be used commercially.

A second disadvantage with moldless electromagnetic casting is that the use of electromagnetic fields to levitate a liquid can result in a number of magnetohydrodynamic (MHD) instabilities that can occur under different circumstances and cause the sheet to lose its shape. If any of these instabilities are allowed to occur in a casting situation, the casting process must be restarted.

The present invention overcomes the aforementioned limitations of the prior art by employing electromagnetic levitation techniques to augment the conventional mold casting approach and prevent the sticking of the solidifying metal to the mold wall. In terms of electromagnetic moldless casting, the mold wall contains the molten metal when an MHD instability occurs. In addition, because the metal is allowed to touch the mold wall, cooling can take place by relatively inexpensive water cooling. In terms of mold casting, the electromagnetic field reduces the contact pressure between the mold wall and the liquid to nearly zero, essentially eliminating or greatly reducing the sliding friction between the mold and the metal. This reduction in friction substantially reduces erosion of the mold wall, thus extending the life of the mold. Also, once the metal has even slightly solidified, a force is exerted upon the metal in a direction perpendicular to and away from the surface of the mold wall.

OBJECTS AND SUMMARY OF THE INVENTION

It is an objective of the present invention to provide an improved method and arrangement for casting thin metal sheets.

It is another objective of the present invention to produce thin metal sheets which require little or no subsequent rolling after the sheet is cast.

A further objective of the present invention is to employ electromagnetic levitation in the casting of metal sheets in near final size and shape.

Another objective of the present invention is to produce a cast metal product having good metallurgical properties and surface characteristics as it leaves the caster.

Yet another objective of the present invention is to cast molten metal in such a way that there is minimal sticking of the solidifying metal to the mold wall.

Still another objective of the present invention is to reduce the erosion and extend the life of the mold wall in a molten metal caster.

A still further objective of the present invention is to electromagnetically cast metal sheets with a minimum of electromagnetic heating of the molten and solid metal.

Another object of the present invention is to provide a system and method which is particularly adapted for the continuous casting of thin sheets of steel.

A more general objective of the present invention is to reduce the cost and complexity of casting thin metal sheets.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIGS. *7a, 7b* and *7c* are vertical sectional views illustrating the eddy current distribution with a molten metal sheet cast in the vertical casting arrangement of FIG. 6; and FIG. 8 is a horizontal sectional view illustrating eddy current distribution within a molten metal sheet depicted in FIG. *7c* taken along sight line 8—8 therein.

DETAILED DESCRIPTION OF THE PREFERRED EMBODIMENTS

Figure 1:
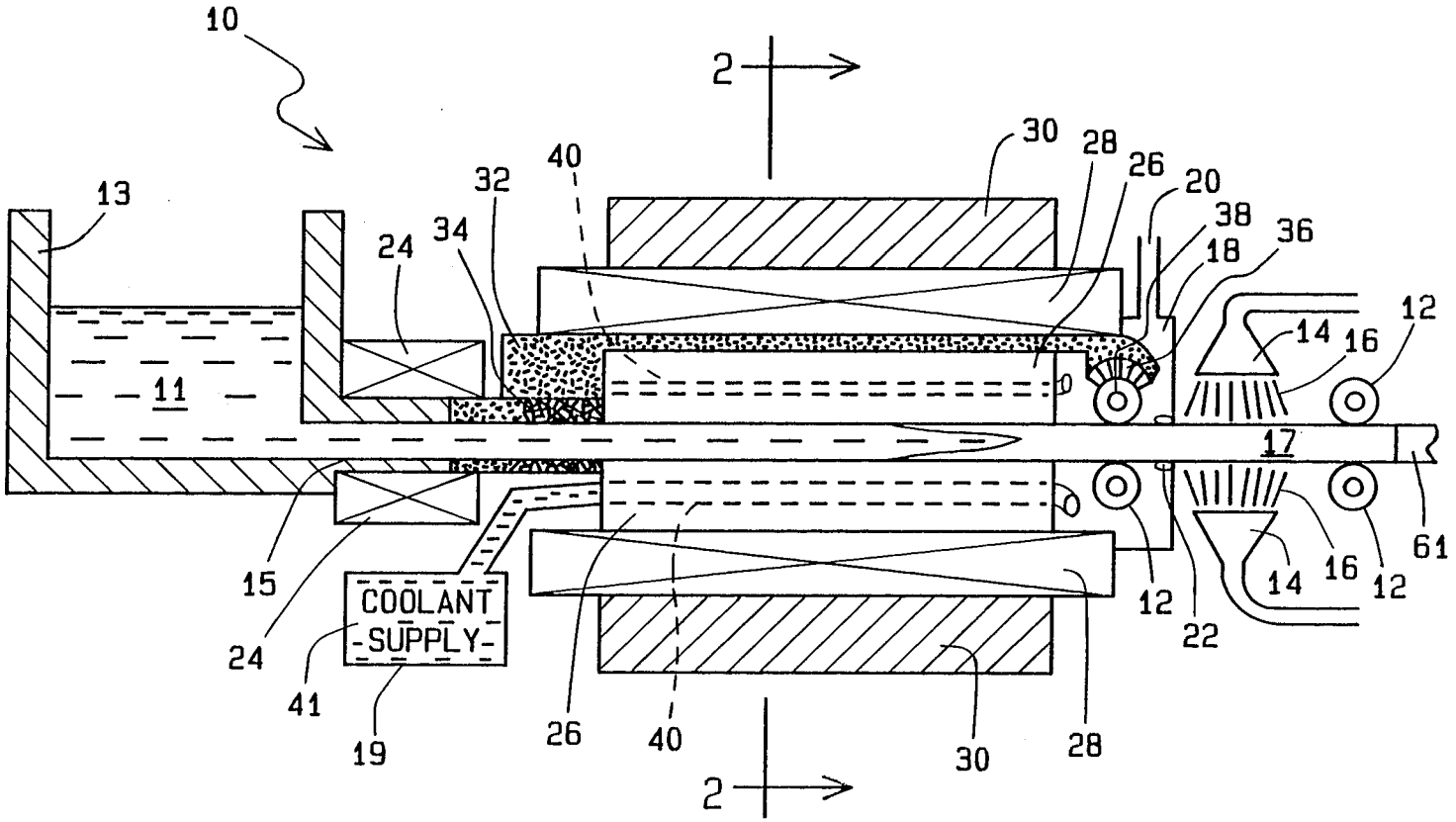
FIG. 1 is a simplified vertical sectional view of a horizontal caster using an AC magnetic field to provide a levitational force for casting thin metal sheets in accordance with the principles of the present invention.
Figure 2:
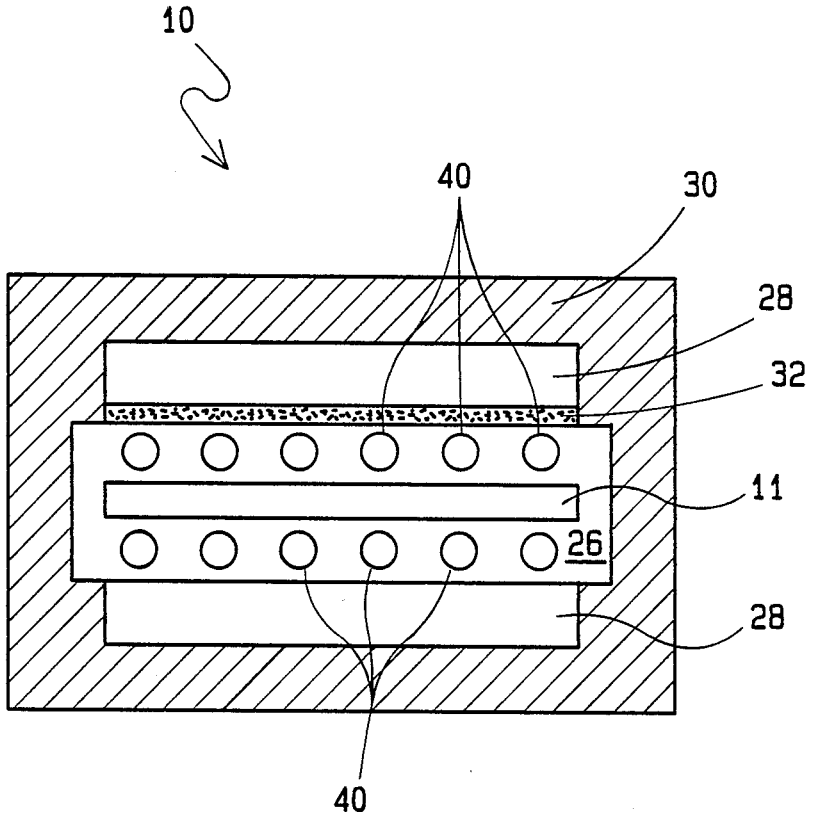
FIG. 2 is a sectional view of the metal sheet horizontal casting arrangement of FIG. 1 taken along sight line 2—2 therein.

Referring to FIG. 1, there is shown a simplified vertical sectional view of a horizontal caster 10 for fabricating thin metal sheets in accordance with the present invention. The horizontal caster 10 includes a tundish 13 containing a molten metal 11. The molten metal 11 is discharged from the tundish 13 via a nozzle 15 in a lower, lateral portion of the tundish to allow the molten metal to flow into a mold 26. The mold 26 includes upper, lower and lateral walls defining an aperture within the mold through which the molten metal flows as shown in the sectional view of FIG. 2 taken along sight line in FIG. 1. The molten metal 11 gives up heat to the horizontal caster 10 as it travels through the mold 26 until it solidifies as a solid metal sheet 17 and is capable of being supported and guided by one or more rollers 12. A belt or other equivalent support structure could be used in place of the rollers 12 to provide support for the linearly displaced solid metal sheet 17. The solid metal sheet 17 is further cooled by a water spray 16 discharged from a pair of spaced nozzles 14. As shown in FIG. 1, the molten metal 11 forms a V-shaped interface with the solidified metal sheet 17. Discharge of the molten metal 11 from the tundish 13 causes linear displacement of the solidified metal sheet 17 as it is discharged from the horizontal caster 10. The exit end of the horizontal caster 10 may be enclosed by a cover 18 containing an inert gas directed into the cover via an inlet tube 20. The cover 18 is provided with an aperture 22 through which the solid metal sheet passes as it exits the horizontal caster 10. The inert gas provided under pressure to the cover 18 also contributes to heat removal from the solid metal sheet 17. A leader sheet 61 having electromagnetic characteristics similar to those of the molten metal sheet is used to start the casting process and precedes the molten metal sheet through the mold and magnet arrangement.

Discharge of the molten metal 11 from the tundish 13 is controlled by an electromagnetic gate 24 disposed about the tundish's nozzle 15. The electromagnetic gate 24 may be a traveling wave magnet, a linear induction motor, or the equivalent thereof. The present invention also contemplates the use of slide gates (not shown) positioned adjacent to the nozzle 15 of the tundish 13 for controlling molten metal flow out of the tundish.

Disposed above and below the mold 26 are a pair of AC conducting coils 28. Disposed about the combination of the mold 26 and pair of AC conducting coils 28 is a ferromagnetic yoke 30. Disposed between an upper portion of the mold 26 and the upper AC coil is an eddy current return path 32 described below. As described earlier, the metal being cast by the horizontal caster 10 transits the mold 26 both as molten metal 11 and as a solidified metal sheet 17. The mold 26 is preferably comprised of a ceramic material such as boron nitride or similar material having good thermoconductivity and high electrical resistivity. The mold 26 should also preferably be comprised of a material which exhibits low chemical reactivity with the metal being cast either in molten or in solid form and should be resistant to wetting by the molten metal. The mold 26 is also provided with a plurality of ducts or passages 40 through which a coolant fluid may be circulated. The network of ducts 40 is coupled to a coolant supply 19 which provides a coolant 41 for circulation through the ducts in removing heat from the metal in both the molten and solidified form as it transits through the mold 26.

The alternating magnetic field established by the AC conducting coils 28 induces eddy currents within the metal sheet. These eddy currents interact with the alternating magnetic field to produce an upward levitational force upon the metal sheet. An eddy current return path is provided in the horizontal caster 10 and includes an electrode 34 in contact with the molten metal sheet 11, a return path 32, brushes 36, and a roller 38. The electrode 34 is preferably comprised of a material having high electrical conductivity and low reactivity to the molten metal. An example of such a material is tungsten, or a carbon-carbon composite, coated with a thin protective layer of silicon carbide.

Most of the induced eddy currents in the metal sheet return via return path 32, which is preferably comprised of copper or other material having low electrical resistivity. However, some of the induced eddy current are in the form of a loop in the metal sheet and return along the top of the metal sheet producing a magnetic field in the upper portion of the sheet and causing a downward force to be exerted on the upper surface of the metal sheet. The magnetic force on the bottom of the metal sheet is larger than the force exerted on its upper surface due to the presence of the eddy current return path 32 above the metal sheet which excludes, or at least substantially reduces, the magnetic field above the molten metal sheet. This results in a net magnetic force upward and hence levitation of the metal sheet. The AC current in conducting coils 28 is adjusted so that the force on the lower surface of the metal sheet cancels the metallostatic head produced by gravity.

The frequency of the AC field produced by the current in the conducting coils 28 is selected so as to promote stirring within the molten metal sheet. To promote stirring within the metal sheet, the frequency of the alternating magnetic field is selected such that the skin depth of the magnetic field in the metal sheet is approximately $\frac{1}{3}$ of the sheet thickness. However, magnetic field frequency and hence the skin depth of the magnetic field may be varied over a considerable range while still allowing for mixing of the molten metal sheet.

As described above, one or more ducts or passages 40 coupled to a coolant supply 19 are provided for within the mold 26. Circulation of a coolant 41 through the mold 26 removes heat from the metal sheet transmitting therethrough. Direct contact of the cooled mold wall with the metal sheet provides a greater heat transfer rate than using a cooling gas directed onto the metal sheet. Cooling by direct contact with the cooled walls of the mold 26 is more efficient than gas cooling even where there is less than complete contact of the metal sheet with the mold wall. This appears to be true even where the walls of the mold 26 are comprised of a non-steel wetting ceramic. By increasing the efficiency of heat transfer from the metal sheet, the length as well as the cost of the horizontal caster 10 may be substantially reduced.

Figure 3:
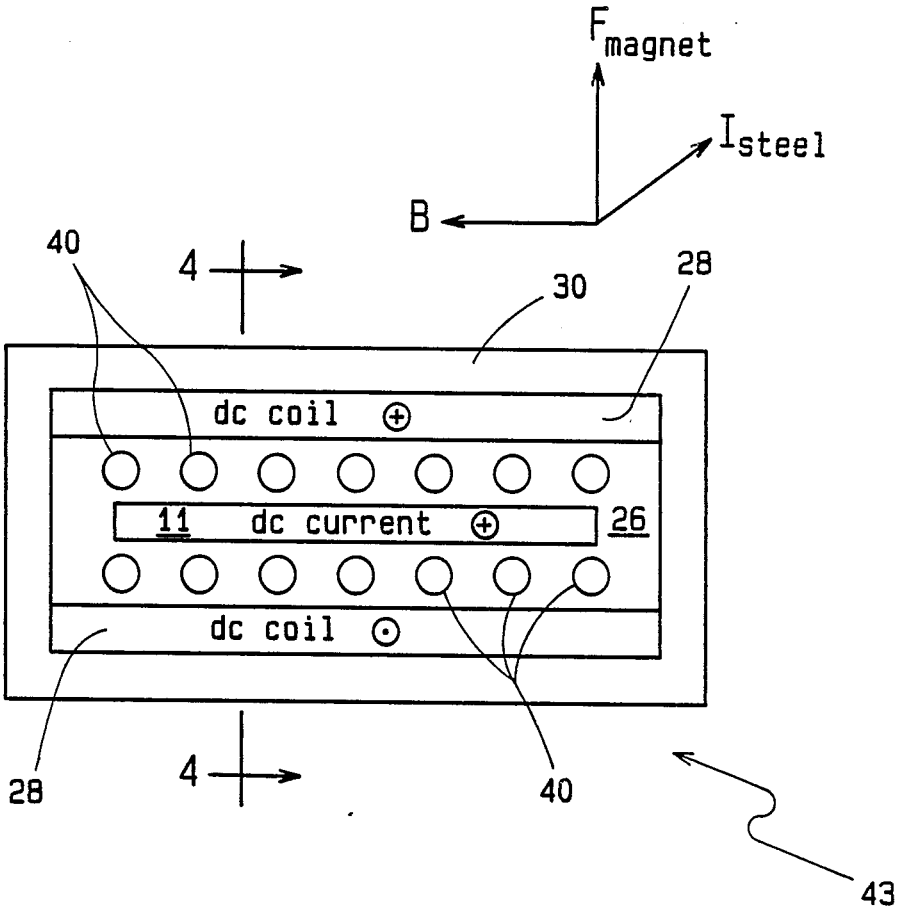
FIG. 3 is a vertical sectional view of a horizontal caster using a DC magnetic field to provide the levitational force, wherein the DC current is directed parallel to the flow of the molten metal sheet in accordance with the present invention.
Figure 4:
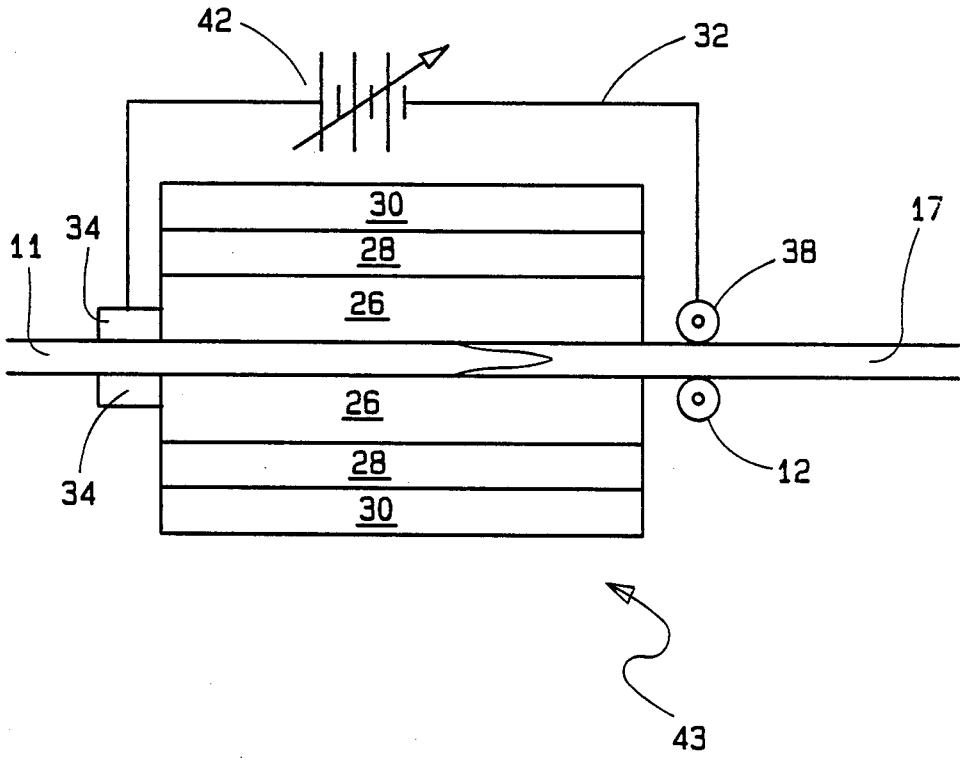
FIG. 4 is a lateral sectional view of the metal sheet horizontal casting arrangement of FIG. 3 illustrating additional details of this arrangement.

Referring to FIG. 3, there is shown another embodiment of a horizontal caster arrangement 43 which makes use of direct rather than alternating current in the conducting coils 28. FIG. 4 illustrates a sectional view of the horizontal caster illustrated in FIG. 3 taken along sight line 4—4 therein and shows additional details of this arrangement. The DC current in the conducting coils 28 flows in directions parallel and anti-parallel to the flow direction of the metal sheet 11. The DC current within the conducting coils 28 in combination with the yoke 30 produces a uniform, constant horizontal magnetic field above, below and within the molten metal sheet 11 and the solidified metal sheet 17. The direction of the DC current within the molten metal sheet 11 as well as within the solidified metal sheet is illustrated in FIG. 3 as directed into the plane of the sectional view illustrated in FIG. 3. The DC current within the metal sheet is therefore in the same direction as the DC current in the upper conducting coil and is in the opposite direction to the DC current within the lower conducting coil. As shown in FIG. 4, a variable DC power supply 42 is coupled between the nozzle electrode 34 positioned adjacent to where the molten metal sheet 11 is introduced into the mold 26 and the roller electrode 38 positioned adjacent to where the solid metal sheet 10 exits the mold. The DC current within the metal sheet interacts with the aforementioned horizontal magnetic field about the metal sheet to produce an upward force on the metal sheet. The DC current within the metal sheet is controlled by varying the voltage of the DC power source 42 in such a way as to cancel the force of gravity on the metal sheet. Alternatively, the current within the DC conducting coils 28 can be adjusted to change the DC magnetic field so as to cancel the force of gravity.

An advantage of the DC current horizontal casting arrangement illustrated in FIGS. 3 and 4 over the AC field approach previously discussed is that a large DC magnetic field can be used allowing smaller currents to flow within the conducting coils 28. This permits the DC current within the conducting coils 28 and the metal sheet to be reduced to a value much less than the AC eddy currents in the surface of the metal sheet. Reduction of the current within the coils 26 and the metal sheet results in substantially reduced erosion of the nozzle electrode 34 and the roller electrode 38. An additional advantage of the use of a DC current within the conducting coils 28 as opposed to an AC current flowing therein is that the power required to achieve an equivalent levitating force is generally less where DC currents are employed.

Figure 5:
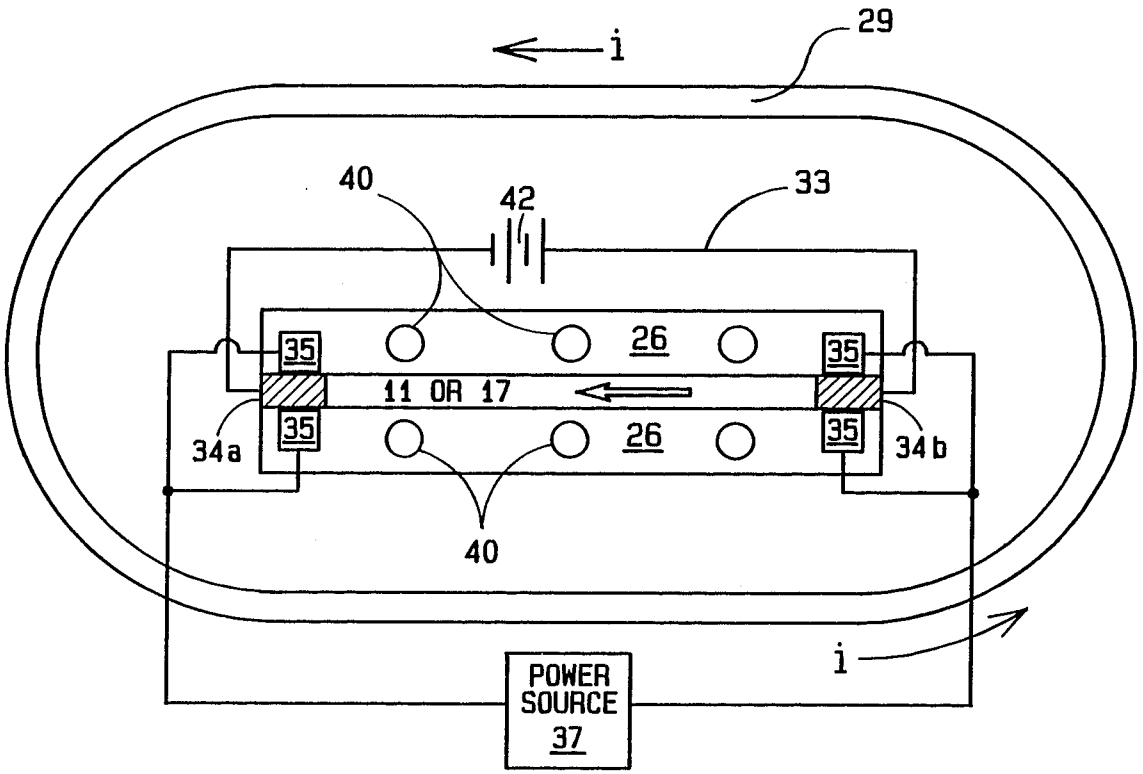
FIG. 5 is a sectional view of another embodiment of a horizontal caster using a DC magnetic field, wherein the DC current is directed perpendicular to the flow of the metal sheet in accordance with the present invention.

Referring to FIG. 5, there is shown a cross sectional view of another embodiment of a horizontal casting arrangement in accordance with the present invention. In the arrangement of FIG. 5, the DC conducting coil is in the form of a solenoid coil 29 with the DC current flowing in the metal sheet, identified as either the molten metal sheet 11 or the solid metal sheet 17, perpendicular to the flow of the metal sheet. Thus, the current arising from the voltage of the DC power supply 42 applied across the metal sheet enters the metal sheet at its right edge as illustrated in FIG. 5 through a first electrode **34*b* and exits the metal sheet at its left edge through a second electrode 34*a*, flowing in the direction of the arrow illustrated therein. In the embodiment of FIG. 5, the magnetic field generated by the solenoid coil 29 is in a direction parallel to the flow of the metal, or generally perpendicular to the plane of the figure and extending outward therefrom. The electrodes 34*a* and 34*b* can be segmented and independent so as to provide a uniform current through the entire length of the metal sheeting including its molten and solidified portions. An advantage of the embodiment of FIG. 5 is that the removal of the current from the metal sheet is not dependent upon the mechanical contact of a roller with the metal sheet. In this approach, current enters into and exits from the molten metal sheet via a respective electrode with which the metal sheet is in constant contact. However, as the metal sheet solidifies, contact between the metal sheet and the electrodes will be reduced such that the current flows within the metal sheet only through the molten portion thereof. The edges of the metal sheet, however, can be maintained in a liquid state by providing auxiliary heating near the edges thereof by means of a plurality of heating elements 35 positioned within or adjacent to the mold 26 and energized by a power source 37**.

Figure 6:
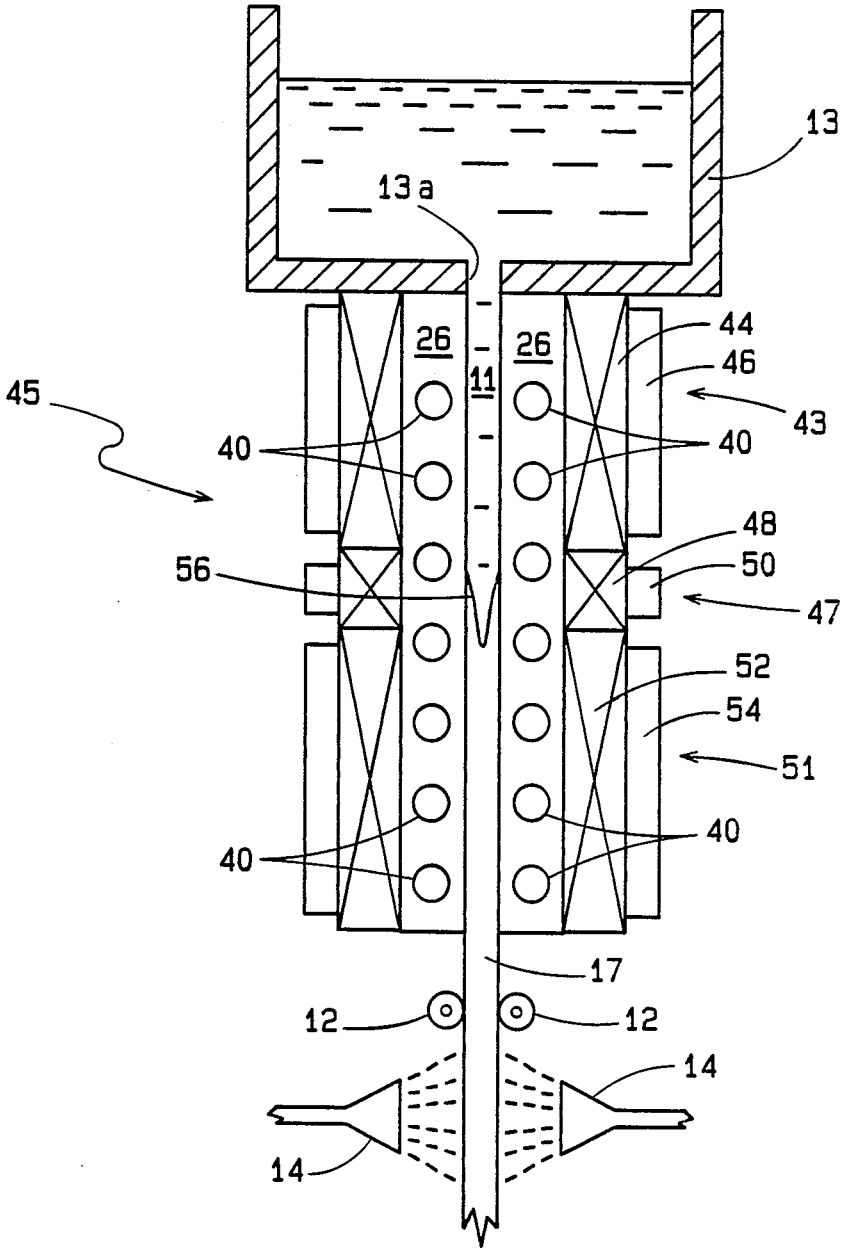
FIG. 6 is a vertical sectional view of a vertical caster using several AC magnetic fields to exert a confining force upon a molten metal sheet at several locations in the casting process in accordance with the present invention.

Referring to FIG. 6, there is shown a vertical caster 45 in accordance with the principles of the present invention. In the vertical caster 45, the tundish 13 is located above one or more magnets and includes an aperture 13*a* through which the molten metal flows under the influence of gravity. The molten metal 11 flows from the tundish 13 into a mold 26 comprised of a plurality of spaced walls defining a generally rectangular aperture therethrough. As in the previously described embodiments, the mold 26 includes a plurality of ducts 40 through which a coolant is circulated. The metal sheet exits the vertical caster 45 as a solid metal sheet 17 when it is sufficiently solidified to be supported by a pair of spaced rollers 12. The solidified metal sheet 17 may be further cooled by a liquid spray directed onto the metal sheet via a pair of spaced, facing nozzles 14. Disposed about the mold 26 are an upper magnet 43, an intermediate magnet 47, and a lower magnet 51. The upper magnet 43 controls the flow of the molten metal sheet 11 and reduces fluid pressure. The intermediate magnetic 47-functions to push the metal inward away from the walls of the mold 26 during the solidification process. The lower magnet 51 operates to push the solidified metal sheet 17 away from the walls of the mold 26 in reducing friction below the solidification front 56.

The upper magnet 43 is comprised of a coil 44 and a yoke 46 and operates as a magnetic brake in controlling the flow of the molten metal sheet 11 and reducing the metallostatic pressure of the metal when it is in the liquid state. In addition, the upper magnet 43 may apply an inward force on the molten metal sheet 11 to reduce the fluid pressure against the walls of the mold 26. The upper magnet 43 may be a single-sided, linear induction motor, a double-sided linear induction motor, or a traveling wave set of coils.

The intermediate magnet 47 is comprised of a coil 48 and a yoke 50 and functions as a vertical confinement magnet. The intermediate magnet 47 operates to reduce the pressure of the metal sheet to near zero during the solidification process adjacent to the solidification front 56 and to assist in pushing the solid skin of the just solidified metal sheet 17 away from the walls of the mold 26. The force arising from the magnetic field generated by the intermediate magnet 47 is exerted on the molten metal sheet 11 a short distance above the solidification front 56 and below the solidification front over a length where the interior of the metal sheet is still liquid although the outer portion thereof has solidified. The magnitude of the magnetic pressure exerted by the intermediate magnet 47 upon the metal sheet balances the metallostatic pressure of the metal sheet exerted upon the interior walls of the mold 26.

The lower magnet 51 is comprised of a coil 52 and a yoke 54 and functions to reduce the pressure of the solid metal sheet 17 against the inner walls of the mold 26 in reducing the friction between the moving metal sheet and the stationary mold. The lower magnet 51 need only exert a force perpendicular to the direction of flow of the solidified metal sheet 17 which is constant in magnitude over the vertical length of the lower magnet. The lower magnet 51 may be comprised of a relatively simple solenoid.

Referring to FIGS. *7a, 7b* and *7c*, there are shown horizontal sectional views of portions of the metal sheet respectively disposed between the upper magnet 43, the intermediate magnet 47, and the lower magnet 51 illustrating the eddy current distribution therein. From these figures, it can be seen that in the vertically cast metal sheet the eddy currents flow generally transverse to the downward direction of the metal sheet transport. Referring to FIG. *7a*, the eddy current distribution in the molten metal sheet within the upper magnet 43 is shown for a traveling wave magnetic field. In FIG. *7b*, the eddy current distribution within the metal sheet is illustrated for a simple magnetic field with increasing intensity toward the solidification point. Finally, the eddy current distribution illustrated in FIG. *7c* is associated with a solenoid magnet. All of the aforementioned magnetic fields are of the AC type.

FIG. 8 is a sectional view of the metal sheet of FIG. *7c* taken along sight line 8-8 therein which also illustrates eddy current distribution within the metal sheet. As shown in FIG. 8, the eddy currents within the metal sheet are concentrated adjacent to the outer surface thereof and circulate in a counterclockwise direction with the metal sheet viewed along the direction in which it is displaced by gravity. The eddy currents flow in a closed loop within the metal sheet and may be reduced in or removed from the metal sheet by any of the arrangements described above. Where an AC magnetic field is utilized, the eddy currents will reverse direction in time.

There has thus been shown an apparatus and method for casting thin metal sheets using a mold in combination with a magnetic field. The magnetic field exerts a confining force upon the molten metal sheet as it transits the mold for reducing contact pressure between the metal sheet and the mold. Intimate contact between the metal sheet and the mold and the reduction of the temperature of the mold by means of a coolant circulated therein provide improved metal sheet cooling efficiency allowing the caster to be shorter and cheaper. A magnet disposed about the mold includes a pair of conducting coils which may carry either alternating or direct current in various embodiments of the present invention.

While particular embodiments of the present invention have been shown and described, it will be obvious to those skilled in the art that changes and modifications may be made without departing from the invention in its broader aspects. For example, the AC conducting coils may also be of the racetrack or bedstead type. In addition, the conducting coils as well as the magnetic field shield may be positioned beneath the molten metal sheet as taught in the above referenced patent to Hull et al. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

The embodiments of the invention in which an exclusive property or privilege is claimed are defined as follows:

1. Apparatus for the horizontal casting of thin metal sheets, said apparatus comprising:

vessel means containing a molten metal and including an aperture for discharging said molten metal in the form of a thin horizontal sheet;

mold means for receiving, confining and directing said molten metal sheet and for removing heat from said molten metal sheet in effecting the solidification thereof;

electromagnetic conducting means including a DC conductor disposed about said metal sheet for directing a DC magnetic field along the direction of displacement of and about said metal sheet; and a DC voltage source coupled to said metal sheet for establishing a direct current therein, such that said direct current interacts with said DC magnetic field for generating and exerting a constant uniform levitation force on said metal sheet wherein the pressure exerted by said metal sheet upon said mold means is reduced to zero.

2. The apparatus of claim 1 further comprising cooling means coupled to said mold means for reducing the temperature of said mold means and effecting increased cooling of said metal sheet.

3. The apparatus of claim 1 further comprising leader sheet means coupled to the aperture in said vessel means and in contact with molten metal therein for establishing initial electromagnetic conditions within said electromagnetic conducting means prior to discharge of the molten metal sheet from said vessel means.

4. The apparatus of claim 3 wherein said leader sheet means possesses electromagnetic characteristics substantially identical to those of the molten metal sheet.

5. The apparatus of claim 1 wherein said direct current flows in the metal sheet in a direction generally transverse to the direction of displacement of the metal sheet.

6. The apparatus of claim 5 wherein said DC magnetic field is aligned generally parallel to the direction of displacement of the metal sheet.

7. The apparatus of claim 6 further comprising electrodes coupling said DC voltage source to the metal sheet.

8. The apparatus of claim 7 wherein said electrodes are each comprised of a plurality of segments.

* * * * *